US005416844A

United States Patent [19]

Nakaji et al.

[11] Patent Number: 5,416,844

[45] Date of Patent: May 16, 1995

[54] APPARATUS FOR REDUCING NOISE IN SPACE APPLICABLE TO VEHICLE PASSENGER COMPARTMENT

[75] Inventors: Yoshiharu Nakaji; Izuho Hirano, both of Yokosuka; Kazuhiro Doi, Yokohama; Tsutomu Hamabe, Yokosuka; Kenichiro Muraoka; Koji Yamada, both of Yokohama, all of Japan

[73] Assignee: Nissan Motor Co., Ltd., Yokohama, Japan

[21] Appl. No.: 26,151

[22] Filed: Mar. 3, 1993

[30] Foreign Application Priority Data

Mar. 4, 1992 [JP] Japan ..... 4-047209

[51] Int. Cl.[6] ..... G10K 11/16

[52] U.S. Cl. ..... 381/71

[58] Field of Search ..... 381/71, 94

[56] References Cited

U.S. PATENT DOCUMENTS 4,153,815 5/1979 Chaplin et al. ..... 381/71
5,117,401 5/1992 Feintuch ..... 381/71

FOREIGN PATENT DOCUMENTS 0410685 1/1991 European Pat. Off. ..... 381/71
3-259722 11/1991 Japan .
2149614A 6/1985 United Kingdom .

OTHER PUBLICATIONS

Elliott et al., "A Multiple Error LMS Algorithm and Its Application to the Active Control of Sound and Vibration" IEEE transactions, on Acoustics, vol. Assp 35, No. 10, Oct. 1987, pp. 1423–1433.

Widrow et al "Adaptive Noise Cancelling: Principles and Applications" Proceedings of the IEEE, vol. 653, No. 12, Dec. 1975, pp. 1692–1716.

*Primary Examiner*—Forester W. Isen

*Attorney, Agent, or Firm*—Lowe, Price, LeBlanc & Becker

[57] ABSTRACT

An apparatus for reducing periodical noises transmitted from a noise source into a vehicle passenger compartment. The apparatus comprises control sound sources for producing control sounds in the vehicle passenger compartment, residual noise sensors for detecting the residual noises in the vehicle passenger compartment, transfer function filters modeled on transfer function between the control sound sources and the residual noise sensors, and adaptive digital filters having variable filter coefficients. A reference signal is produced in the form of a series of impulses having the same period as the noises. The transfer function filters are convoluted with the reference signal to produce reference processed signals. The adaptive digital filters are convoluted with the reference signal to generate drive signals to drive the control sound sources. The filter coefficients of the respective adaptive digital filters are updated based on the processed reference signals and the residual noises to reduce the noises in the vehicle passenger compartment.

14 Claims, 12 Drawing Sheets

APPARATUS FOR REDUCING NOISE IN SPACE APPLICABLE TO VEHICLE PASSENGER COMPARTMENT

BACKGROUND OF THE INVENTION

This invention relates to an apparatus for reducing periodical noises transmitted into a vehicle passenger compartment from a noise source by producing control sounds for interference with the transmitted periodical noises.

For example, British Patent No. 2,149,614 published on Jun. 12, 1985, discloses a conventional noise reduction apparatus for use in airplane passenger compartments or like spaces. The conventional noise reduction apparatus is applicable to reduce noises transmitted from a single source of noises having a fundamental frequency $f_0$ and its higher harmonics $f_1$ to $f_n$. The noise source is an engine or the like placed in the exterior of such a space as described above. A plurality of microphones are placed at different positions within the space for detecting the sound pressures applied thereon. In order to produce control sounds for interference with the transmitted noises, a plurality of loudspeakers are placed at different positions within the space. The loudspeakers are driven by drive signals having frequencies in opposite phase to the frequencies $f_0$ to $f_n$ of the transmitted noises to cancel the transmitted noises. A "WIDROW LMS" algorithm developed for multiple channels is used to drive the loudspeakers. The "WIDROW LMS" algorithm is described in an article published 1975, in PROCEEDINGS OF THE IEEE, Vol. 63, page 1692, entitled "Adaptive Noise Cancellation: Principles and Applications". The "WIDROW LMS" algorithm developed for multiple channels is described in an article published 1987, in IEEE TRANS. ACOUST.,-SPEECH, SIGNAL PROCESSING, VOL. ASSP-35, PP. 1423–1434 entitled "A MULTIPLE ERROR LMS ALGORITHM AND ITS APPLICATION TO THE ACTIVE CONTROL OF SOUND AND VIBRATION".

The LMS (least mean square) algorithm is one of appropriate algorithms for use in updating the filter coefficients of adaptive digital filters. For example, in a so-called Multiple Error Filtered X LMS algorithm, all of the transfer function filters modeled on the transfer functions between the loudspeakers and the microphones are set for all of the loudspeaker-microphone combinations. The filter coefficients of each of the variable filter coefficient digital filters provided for the respective loudspeakers are updated in a manner to reduce the value of a predetermined performance function calculated based upon the residual noise levels detected by the respective microphones using the reference signal, indicative of the noise generating condition of the noise source, processed for the filter.

With the conventional noise reduction apparatus, however, the reference signal indicative of the noise genera ting condition is taken in the form of a continuous signal such as a sine wave. For this reason, it is required to repeat a great number of calculations in the convolutional calculations of the reference signal and the transfer function filters and the convolutional calculations of the reference signal and the adaptive digital filters. The required calculations include multiplying the series of values obtained by sampling the continuous signal at intervals of a predetermined time and the filter coefficients of the transfer-function and adaptive-digital filters and summing the multiplied results.

SUMMARY OF THE INVENTION

It is a main object of the invention to provide an improved noise reducing apparatus which can utilize simplified calculations to perform high speed noise reduction.

There is provided, in accordance with the invention, an apparatus for reducing periodical noises transmitted from a noise source into a vehicle passenger compartment. The noise reducing apparatus comprises control sound sources for producing control sounds in the vehicle passenger compartment, reference signal generating means for producing a reference signal in the form of a series of impulses having the same period as the noises, residual noise detecting means for detecting residual noises at predetermined positions in the vehicle passenger compartment, transfer function filters modeled on transfer functions between the control sound sources and the residual noise detecting means, reference processed signal generating means for convoluting the transfer function filters with the reference signal to produce reference processed signals, adaptive digital filters having variable filter coefficients, drive signal generating means for convoluting the adaptive digital filters with the reference signal to generate drive signals to drive the control sound sources, and adaptive processing means for updating the filter coefficients of the respective adaptive digital filters based on the reference processed signals and the residual noises to reduce the noises in the vehicle passenger compartment.

The drive signal generating means convolutes the adaptive digital filters with the reference signal to generate drive signals to drive the control sound sources. Thus, the control sound sources produce control sounds related to the noises transmitted from the noise source. Just after the noise reduction control starts, the filter coefficients of the respective adaptive digital filters would not converge to values appropriate for minimizing the noises in the vehicle passenger compartment. The reference processed signal generating means convolutes the transfer function filters with the reference signal to produce reference processed signals. The adaptive processing means updates the filter coefficients of the respective adaptive digital filter based upon the reference processed signals and the residual noises detected by the residual noise detecting means in a manner to reduce the noises in the vehicle passenger compartment. As a result, the control sounds produced from the control sound sources cancel the noises. The reference signal produced from the reference signal generating means is in the form of a series of impulses having the same period as that of the noises transmitted from the noise source. The responses of the transfer function filters or the adaptive digital filters with respect to each of the impulses of the reference signal are impulse responses and, thus, correspond to the filter coefficients of the transfer function filters or the adaptive digital filters. Consequently, the reference processed signal generating means and the drive signal generating means can perform convolutional calculations merely by summing the filter coefficients.

Preferably, the noise reducing apparatus further includes noise period detecting means for detecting the period of the noises produced from the noise source, and first filter length changing means for changing the filter lengths of the respective transfer function filters based upon the detected noise period. The amount of information on the past impulse responses required for the convolutional calculations can be reduced, for example, if the filter lengths of the transfer function filters are not too long with respect to the period of the noises. This is effective to reduce the required number of the summing operations made for the convolutional calculations.

Preferably, the noise reducing apparatus further includes second filter length changing means for changing the filter lengths of the respective adaptive digital filters based upon the detected noise period. No information on the past impulse responses is required for the convolutional calculations made in the drive signal generating means, for example, if the filter lengths of the adaptive digital filters are equal to the period of the noises. Thus, the drive signal generating means can produce the drive signals merely by outputting the filter coefficients of the adaptive digital filters in synchronism with the reference signal. No summing operation is required in the drive signal generating means.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
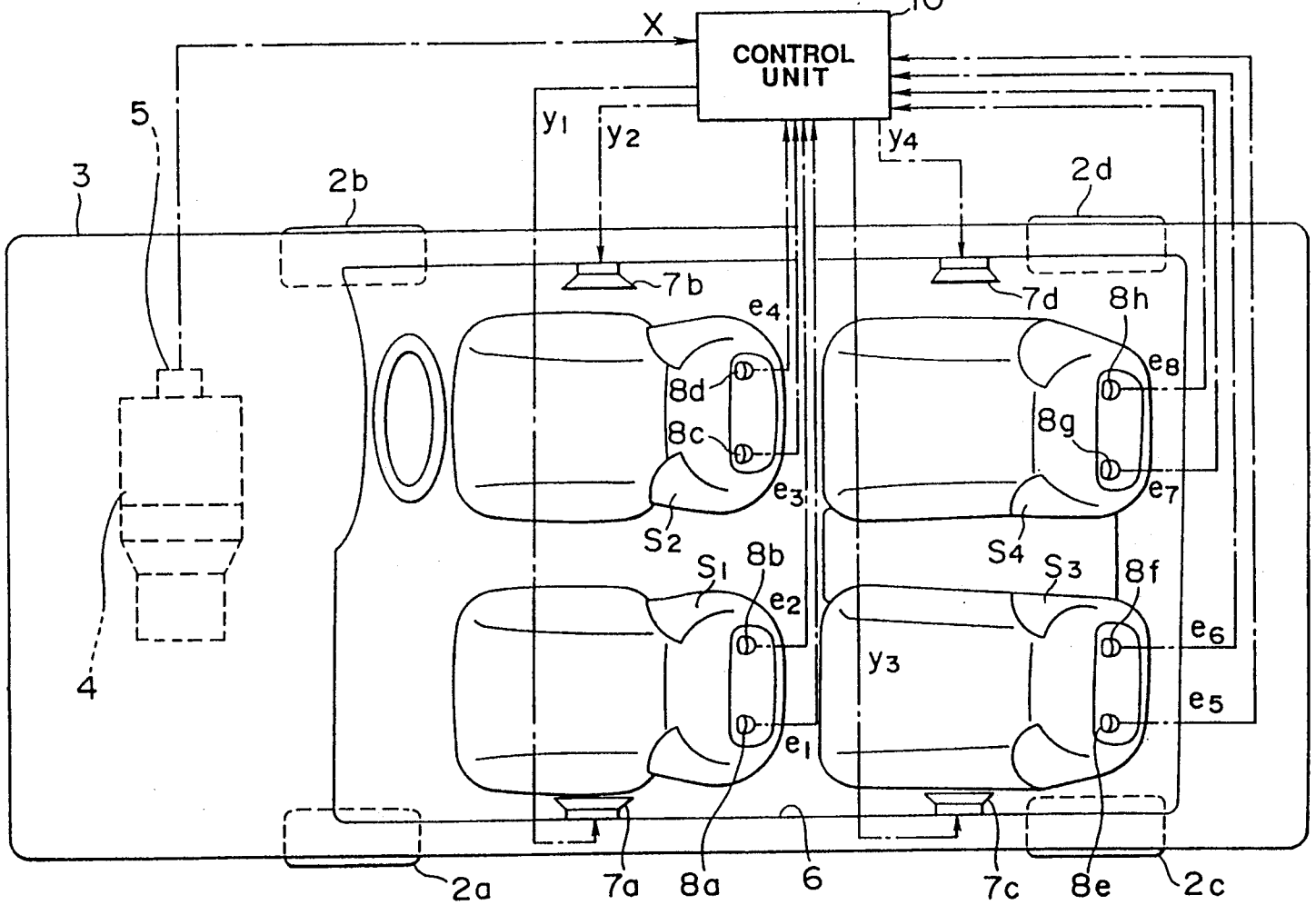
FIG. 1 is a schematic diagram showing one embodiment of a noise reducing apparatus made in accordance with the invention.

With reference to the drawings, and in particular to FIG. 1, there is shown a noise reducing apparatus embodying the invention. The invention will be described in connection with an automotive vehicle supported on a pair of front road wheels *2a* and *2b* and a pair of rear road wheels *2c* and *2d*. The shown automotive vehicle is of the front-engine, front drive (FF) type including a vehicle body 3 and an internal combustion engine 4 positioned in the front part of the vehicle body 3. A suspension is provided between the vehicle body and each road wheel. The engine 4 has an engine crankshaft (not shown) with which a crankshaft position sensor 5 is associated to produce a series of crankshaft position pulses X, each corresponding to one or two degrees of rotation of the engine crankshaft, of a repetition rate directly proportional to engine speed. The crankshaft position pulses X are fed to a control unit 10. The vehicle body 3 is formed to provide a passenger compartment 6 (acoustic space) in which left and right front seats S1 and S2 and left and right rear seats S3 and S4 are installed.

Control sound sources are mounted on left- and right-front and left- and right-rear doors, respectively. The control sound sources are taken in the form of loudspeakers *7a, 7b, 7c* and *7d* directed to the passenger compartment 6, as shown in FIG. 1. The control sound sources are driven by respective drive signals y1, y2, y3 and y4 fed thereto from the control unit 10. A pair of residual noise detectors are mounted on the head rests of each of the seats S1, S2, S3 and S4. The residual noise detectors are taken in the form of microphones *8a* to *8h*. Each microphone senses a sound pressure applied there to and converts it in to a residual noise signal. The residual noise signals e1 to e8 are fed from the respective microphones *8a* to *8h* to the control unit 10.

The control unit 10 may employ a digital computer which includes a central processing unit (CPU), a random access memory (RAM), a read only memory (ROM), and an input/output control unit (I/O). The central processing unit communicates with the rest of the computer via data bus. The input/output control unit includes an analog-to-digital converter which receives residual noise signals e1 to e8 from the respective microphones *8a* to *8h* and converts them into digital form for application to the central processing unit. The A to D conversion process is initiated on command from the central processing unit which selects the input channel to be converted. The read only memory contains the program for operating the central processing unit and further contains appropriate data in look-up tables used in calculating desired values for the drive signals y1 to y4. Control words specifying desired drive signal values are periodically transferred by the central processing unit to the respective digital-to-analog converters included in the input/output control unit. The D/A converters convert the received control words into drive signals y1 to y4 for application to the respective loudspeakers *7a* to *7d*.

Figure 2:
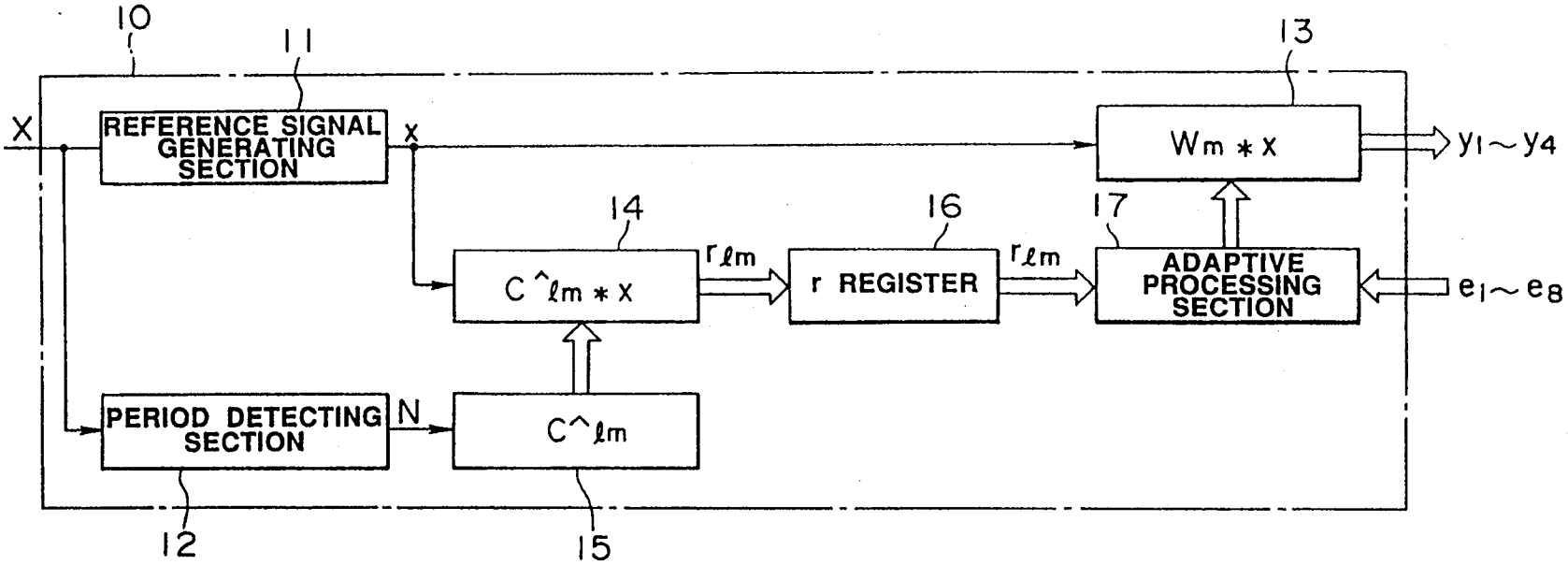
FIG. 2 is a block diagram used in explaining the functions of the control unit used in the noise reducing apparatus of FIG. 1.

The functions performed in the control unit 10 will be described in connection with the following sections as shown in FIG. 2. The reference signal generating section 11 receives the crankshaft position signal X fed from the crankshaft position sensor 5 and generates a reference signal x at a repetitive rate equal to that of the vibrations transmitted from the engine 4 based upon the received crankshaft position signal X. The transmitted vibrations cause noises in the vehicle passenger compartment. The reference signal x is taken in the form of a series of impulses each corresponding to a 180 degrees of rotation of the engine crankshaft when the noise source is a 4-cycle, 4-cylinder engine. The reference signal generation is made based upon the crankshaft position signal X fed to the control unit 10 from the crankshaft position sensor 5. The period detecting section 12 receives the crankshaft position signal X fed from the crankshaft position sensor 5 and detects the period N of the vibrations transmitted from the engine 4 based upon the received crankshaft position signal X, namely, the period detecting section 12 determines the period N of the engine combustion vibration generated on the engine on the basis of the crankshaft position signal X, the period N being a criterion of the sampling period of the reference signal X. The drive signal generating section 13 receives the reference signal x fed thereto from the reference signal generating section 11 and convolutes adaptive digital filters $W_m$ (m=1, 2 . . . M where M is the number of the loudspeakers *7a* to *7d* provided in the vehicle passenger compartment) with the received reference signal x to produce drive signals y1 to y4. The reference processed signal generating section 14 receives the reference signal x fed there to from the reference signal generating section 11 and convolutes transfer function filters $\hat{C}_{lm}$ (l=1, 2 . . . L where L is the number of the microphones *8a* to *8h* provided in the vehicle passenger compartment) modeled in the form of finite impulse response functions on the transfer functions between the loudspeakers *7a* to *7d* and the microphones *8a* to *8h* with the received reference signal x to produce reference processed signals $r_{lm}$. The transfer function filter storing section 15 sets the transfer function filters $\hat{C}_{lm}$ used in the reference processed signal generating section 14 based upon the period N detected in the period detecting section 12. The r register section 16 temporarily stores the reference processed signals $r_{lm}$ fed thereto from the reference processed signal generating section 14. The adaptive processing section 17 receives the reference processed signals from the r register section 16 and also the residual noise signals e1 to e8 fed thereto from the respective microphones *8a* to *8h* and updates the filter coefficients $W_{mi}$ of the respective adaptive digital filters $W_m$ used in the drive signal generating section 13 based upon the received reference processed signals and the received residual noise signals in a manner to reduce the noises in the vehicle passenger compartment. The adaptive processing section 17 utilizes a least mean square (LMS) algorithm to update the filter coefficients $W_{mi}$ of the respective adaptive digital filters.

Figure 3:
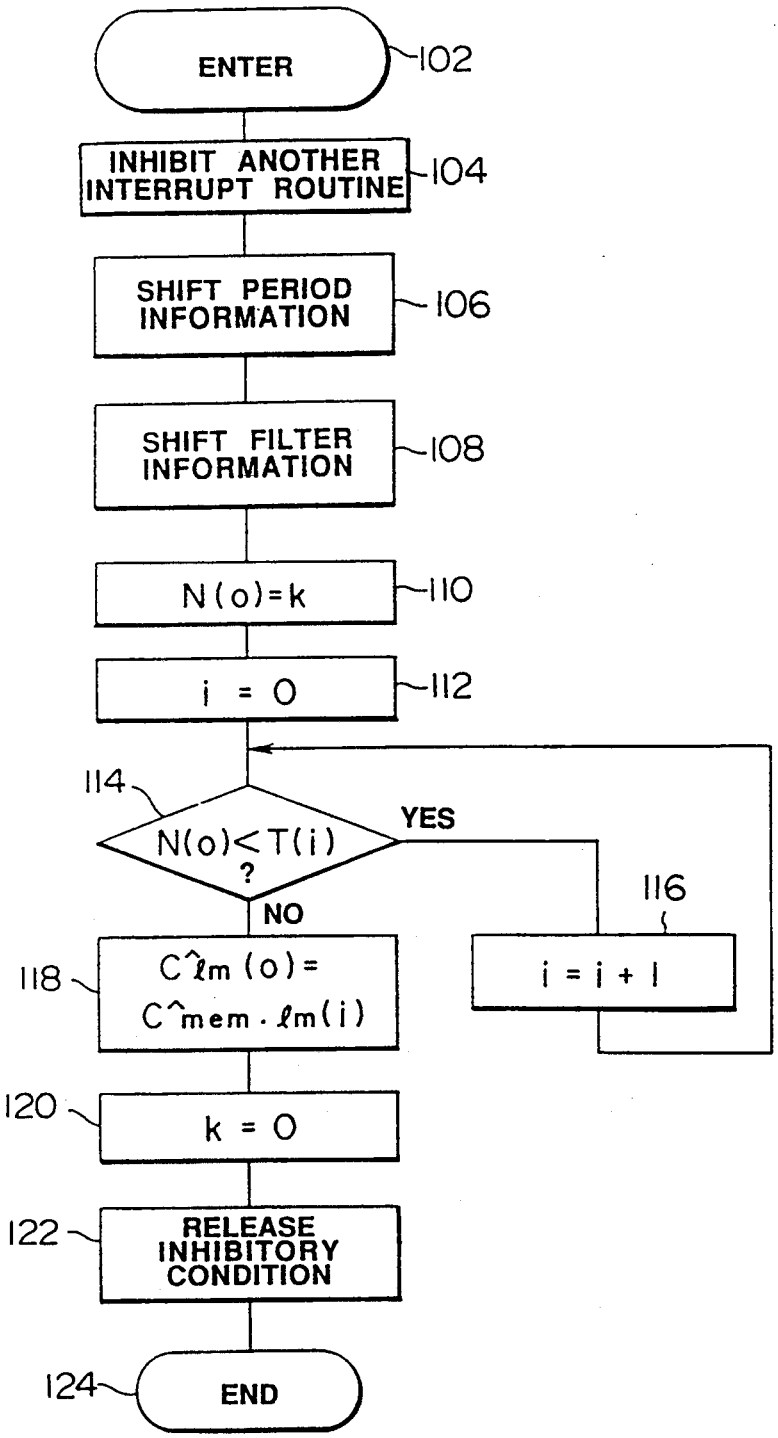
FIG. 3 is a flow diagram of the programming of the digital computer used in the control unit.

FIG. 3 is a flow diagram of the programming of the digital computer used in the control unit 10. The computer program is entered at the point 102 in response to an interrupt signal in the form of an impulse of the reference signal x produced at uniform intervals of rotation of the engine crankshaft. At the point 104 in the program, another interrupt routine is inhibited. At the point 106, the central processing unit shifts the period information N(p) comprised of a series of past noise period values N(P)–N(1) (see FIGS. 5A and 6A) as follows:

$$N(P) = N(P-1)$$
$$N(P-1) = N(P-2)$$
$$\vdots$$
$$N(p) = N(p-1)$$
$$\vdots$$
$$N(2) = N(1)$$
$$N(1) = N(0)$$

The numeral enclosed by the parentheses () affixed to N indicates the number of times the period N was set before the new value is set therefor in the present cycle of execution of the program. At the point 108 in the program, the central processing unit shifts the filter information $\hat{C}_{lm}(p)$ comprised of a series of past transfer function values $\hat{C}_{lm}(1)(P)$–$\hat{C}_{lm}$ (see FIGS. 5B and 5C) as follows:

$$\hat{C}_{lm}(P) = \hat{C}_{lm}(P-1)$$
$$\hat{C}_{lm}(P-1) = \hat{C}_{lm}(P-2)$$
$$\vdots$$
$$\hat{C}_{lm}(p) = \hat{C}_{lm}(p-1)$$
$$\hat{C}_{lm}(2) = \hat{C}_{lm}(1)$$
$$\hat{C}_{lm}(1) = \hat{C}_{lm}(0)$$

The numeral enclosed by the parentheses () affixed to $\hat{C}_{lm}$ indicates the number of times the transfer function filter $\hat{C}_{lm}$ was set before the new value is set therefor in the present cycle of execution of the program. At the point 110 in the program, the count k of the counter is stored in the computer memory as the newest value N(0) of the noise period N. At the point 112 in the program, the count i of an I counter is cleared to zero.

At the point 114 in the program, a determination is made as to whether or not N(0)<T(i). T(i) is one of stepped values into which the possible range of the period N is equally divided. If the answer to this question is "yes", then the program proceeds to the point 116 where the I counter is incremented by one step and it is returned to the point 114. Otherwise, it means that T(i) is the new period value N(0) stored in the computer memory to provide a part of the period information N(p) and the program proceeds to the point 118 where a new value $C_{lm}(0)$ of the filter information is set as $$\hat{C}_{lm}(0) = \hat{C}_{mem.lm}(i)$$

where $\hat{C}_{mem.lm}(i)$ is a predetermined transfer function filter calculated as a function of the period N. The predetermined transfer function filter has a filter length which is not too long with respect to the period N. According to the invention, the transfer function filter $\hat{C}_{lm}$ is set in such a manner that its filter length is not too long with respect to the period N. At the point 120 in the program, the count k of a K counter is cleared to zero. At the point 122 in the program, the inhibitory condition for another interrupt routine is released. Following this, the program proceeds to the end point 124.

Figure 4:
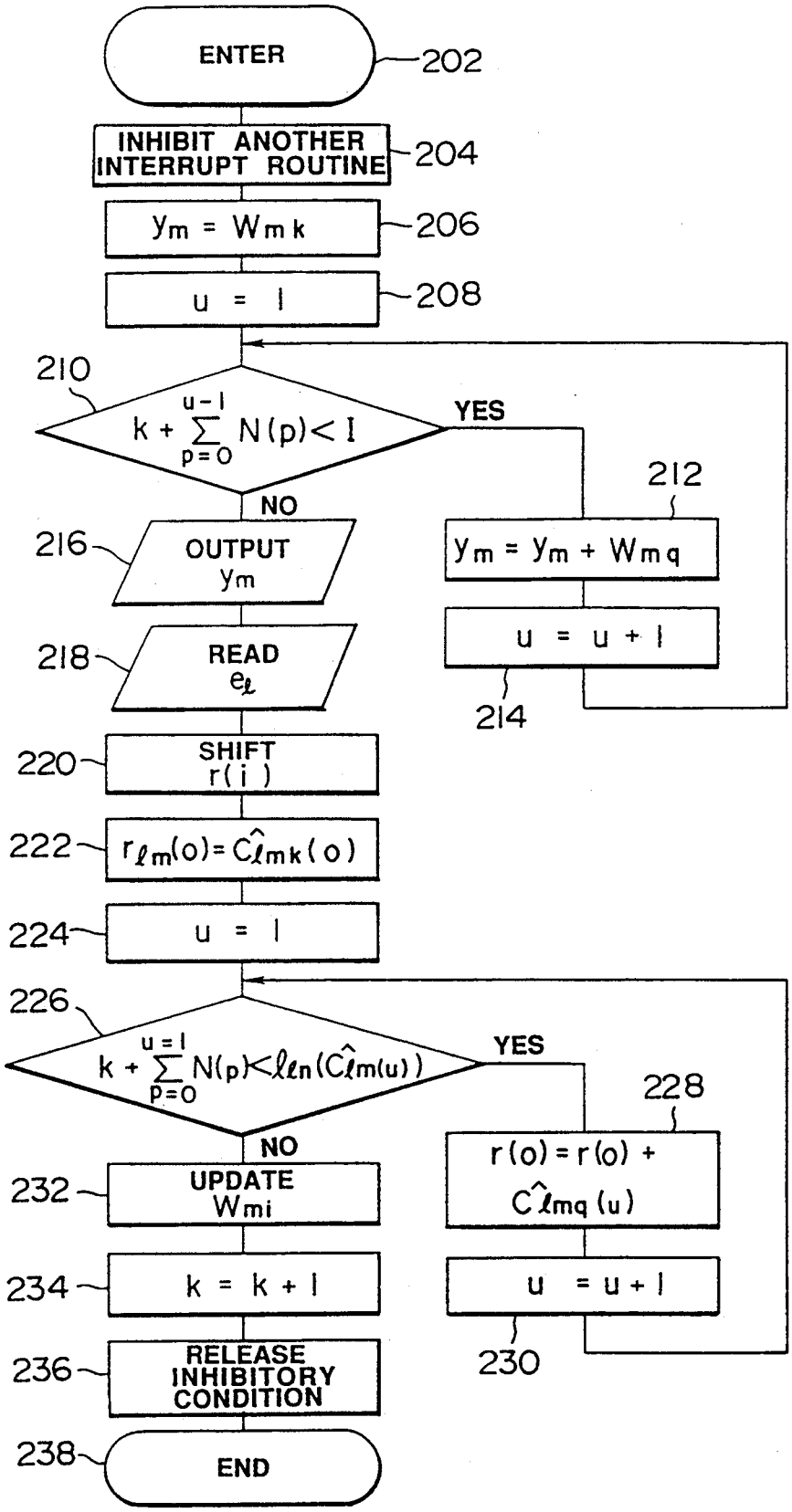
FIG. 4 is a flow diagram of the programming of the digital computer used in the control unit.

FIG. 4 is a flow diagram of the programming of the digital computer used in the control unit 10. The computer program is entered at the point 202 in response to an interrupt signal in the form of a drive signal $y_m$ produced from the control unit 10. At the point 204 in the program, another interrupt operation is inhibited. At the point 206 in the program, the value of the drive signal $y_m$ is initiated to $W_{mk}$ as:

$$y_m = W_{mk}$$

where $W_{mk}$ is the k-th filter coefficient of the adaptive digital filter $W_m$. Thus, the initial value of the drive signal $y_m$ set at the point 206 indicates the response of the adaptive digital filter $W_m$ at the present time k with respect to the last impulse. Since the count k of the K counter is cleared to zero at the point 120 in the program of FIG. 3, the value k is set at zero when a pulse x(n) of the reference signal x is produced. Thus, the value k indicates the number of times the program of FIG. 4 has been executed after the pulse x(n) of the reference signal was produced (see FIGS. 5A and 6A). At the point 208 in the program, the count u of a U counter is set at 1.

At the point 210 in the program, a de termination is made as to whether or not $$k + \sum_{p=0}^{u-1} N(p) < I$$

where I is the filter length (maximum tap number) of the adaptive digital filter $W_m$. If the answer to this question is "yes", then it means that the response of the adaptive digital filter $W_m$ to the impulse produced u impulses before still continues and the program proceeds to the point 212 where the drive signal $y_m$ is accumulated as:

$$y_m = y_m + W_{mq}$$

where $W_{mq}$ is the response of the adaptive digital filter $W_m$ to the pulse produced u pulses before and q is given as:

$$q = k + \sum_{p=0}^{u-1} N(p)$$

At the point 214 in the program, the U counter is incremented by one step. Following this, the program is returned to the point 210.

If the answer to the question inputted at the point 210 is "no", then it means that the response of the adaptive digital filter $W_m$ to the impulse produced u impulses before is distinguished and, thus, the convolutional calculations in the drive signal generating section 13 have been completed and the program proceeds to the point 216 where the drive signal ym is outputted. At the point 218 in the program, the residual noise signals e1 to e8 are read in to the computer memory. At the point 220 in the program, the registers $r_{lm}(I)$ to $r_{lm}(1)$ storing the reference processed signal $r_{lm}$ obtained in the past processes are shifted as:

$$r_{lm}(I) = r_{lm}(I-1)$$
$$r_{lm}(I-1) = r_{lm}(I-2)$$
$$\vdots$$
$$r_{lm}(i) = r_{lm}(i-1)$$
$$\vdots$$
$$r_{lm}(2) = r_{lm}(1)$$
$$r_{lm}(1) = r_{lm}(0)$$

At the point 222 in the program, the register $r_{lm}(0)$ is initialized as:

$$r_{lm}(0) = \hat{C}_{lmk}(0)$$

where $\hat{C}_{lmk}(0)$ is the k-th filter coefficient of the newest transfer function filter $\hat{C}_{lm}(0)$ set at the point 118 in the program of FIG. 3 and it indicates the response of the transfer function filter $\hat{C}_{lm}(0)$ at the present time k to the last impulse. At the point 224 in the program, the U counter is set at 1.

At the point 226 in the program, a determination is made as to whether or not $$k + \sum_{p=0}^{u-1} N(p) < len(C_{lm}(u))$$

where $len(\hat{C}_{lm}(u)$ is the filter length (tap number) of the transfer function filter $\hat{C}_{lm}(u)$ with respect to the impulse inputted u impulses before. If the answer to this question is "yes", then it means that the response of the transfer function filter $\hat{C}_{lm}(u)$ to the impulse inputted u impulses before still continues and the program proceeds to the point 228 where an accumulation is made for the register $r_{lm}(0)$ as:

$$r_{lm}(0) = r_{lm}(0) + \hat{C}_{lmq}(u)$$

where q is given as $$q = k + \sum_{p=0}^{u-1} N(p)$$

where $\hat{C}_{lmq}$ is the response of the transfer function filter $\hat{C}_{lm}(u)$ to the impulse inputted u impulses before. At the point 230 in the program, the U counter is incremented by one step. Following this, the program is returned to the point 226.

If the answer to the question inputted at the point 226 is "no", then it means that the response of the adaptive digital filter $W_m$ to the impulse inputted u impulses before was distinguished and, thus, the convolutional calculations in the drive signal generating section 14 have been completed and the program proceeds to the point 232. At the point 232 in the program, the LMS algorithm is used to update the filter coefficients $W_{mi}$ of the respective adaptive digital filters $W_m$ as:

$$W_{m0} = W_{m0} - \alpha \sum_{l=1}^{L} r_{lm}(0)el$$
$$W_{m1} = W_{m1} - \alpha \sum_{l=1}^{L} r_{lm}(1)el$$
$$\vdots$$
$$W_{mi} = W_{mi} - \alpha \sum_{l=1}^{L} r_{lm}(i)el$$
$$\vdots$$
$$W_{mI} = W_{mI} - \alpha \sum_{l=1}^{L} r_{lm}(I)el$$

where $\alpha$ is the convergence coefficient that takes part in the rate at which the filter converges in an optimum fashion and contributes to the stability of the optimum convergence of the filter. At the point 234 in the program, the K counter is incremented by one step. At the point 236 in the program, the inhibitory condition for another interrupt routine is released. Following this, the program proceeds to the end point 238.

The operation is as follows: Vibrations are transmitted from the engine 4 to produce noises into the vehicle passenger compartment 6. The control unit receives the crankshaft position signal X fed thereto from the crankshaft position sensor 5 and generates a reference signal x comprised of a series of impulses having a period equal to the period of the noises produced in the vehicle passenger compartment (reference signal generating section 11). The control unit 10 produces drive signals y1 to y4 by convoluting the adaptive digital filter $W_m$ with the reference signal x (drive signal generating section 13). The loudspeakers *7a* to *7d* are driven by the respective drive signals y1 to y4 to produce control sounds in the vehicle passenger compartment 6. Since the filter coefficients $W_{mi}$ of the respective adaptive digital filters $W_m$ do not converge to values appropriate for minimizing the noises just after the noise reduction control is initiated, the noises would remain in the vehicle passenger compartment 6. The control unit 10 utilizes the reference processed signal $r_{lm}$ into which the reference signal x is processed by the transfer function filters $\hat{C}_{lm}$ and the residual noise signals e1 to e8 fed thereto from the respective microphones 8*a* to 8*h* to update the filter coefficients $W_{mi}$ of the respective adaptive digital filters $W_m$ according to the LMS algorithm (adaptive processing section 17), as described in connection with the step at the point 232 of FIG. 4. As a result, the filter coefficients converge toward the appropriate values so that the control sounds produced from the loudspeakers 7*a* and 7*b* can cancel the residual noises in the vehicle passenger compartment 6.

Figure 5:
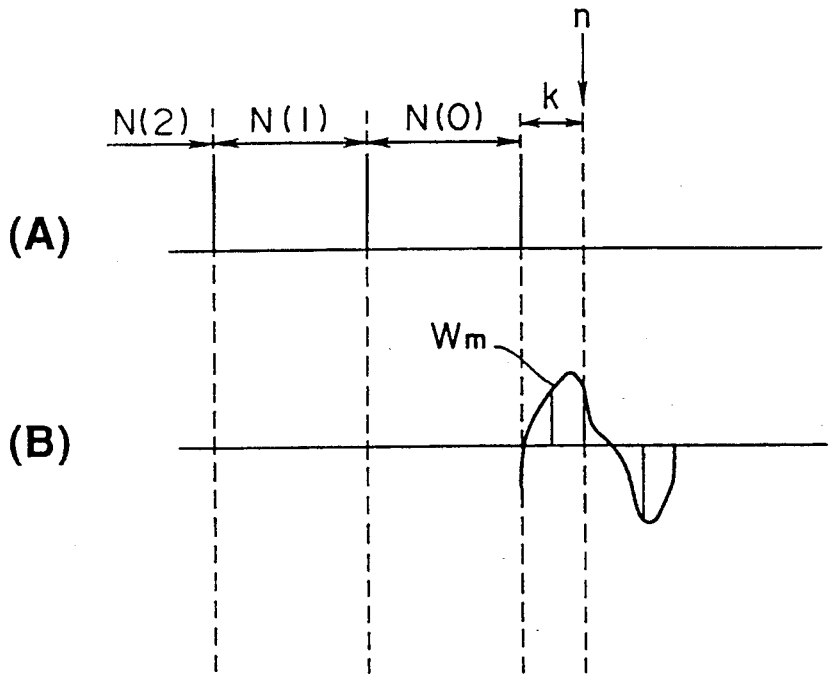
FIG. 5 contains two waveforms (A) and (B) used in explaining the convolutional calculations of the adaptive digital filter and the reference signal.
Figure 6:
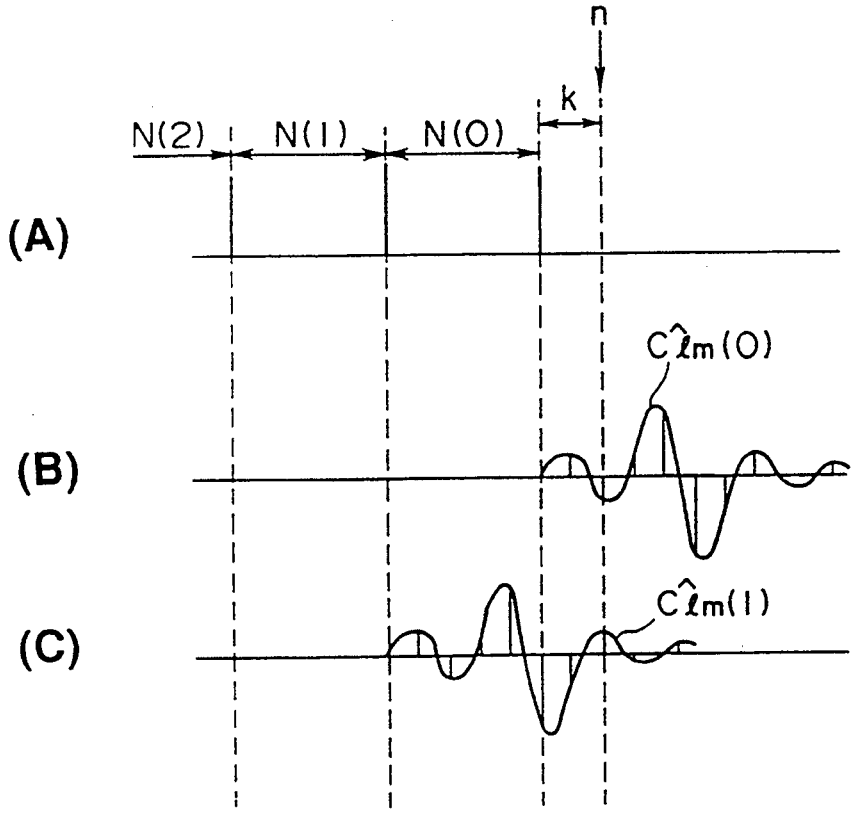
FIG. 6 contains three waveforms (A), (B), and (C) used in explaining the convolutional calculations of the transfer function filter and the reference signal.

Since the reference signal x outputted from the reference signal generating section 11 is in the form of a series of impulses having the same period N as the noises, as shown in FIG. 5A, the response of the adaptive digital filter $W_m$ to each of the impulses of the reference signal x corresponds to the filter coefficient $W_{mi}$ of the adaptive digital filter $W_m$, as shown in FIG. 5B. It is, therefore, possible to make convolutional calculations of the adaptive digital filter $W_m$ and the reference signal x merely by summing the filter coefficients $W_{mk}$ at a sampling time k in the steps at the points 206 to 214 of FIG. 4, the filter coefficients $W_{mk}$ corresponding to the continuing responses of the adaptive digital filters. Since the reference signal x is in the form of a series of impulses, however, no drive signal $y_m$ is produced in the latter half cycle of the period N of the noises when the noise period N is elongated if the filter length of the adaptive digital filter $W_m$ is too short or the tap number is too small. It is, therefore, required to set the filter length of the adaptive digital filter $W_m$ at an appropriate great value. Since the reference signal x is in the form of a series of impulses having the same period as the noises for the convolutional calculations of the reference signal x and the transfer function filter $\hat{C}_{lm}$, as shown in FIG. 6A, the response of the transfer function filter $\hat{C}_{lm}$ to each of the impulses of the reference signal x corresponds to the filter coefficient $\hat{C}_{lmk}(p)$ of the transfer function filter $\hat{C}_{lm}(p)$. It is, therefore, possible to make convolutional calculations of the transfer function filter $\hat{C}_{lm}$ and the reference signal x merely by summing the filter coefficients $\hat{C}_{lmk}(p)$ at the sampling time k in the steps at the points 222 to 230 of FIG. 4, the filter coefficients $C_{lmk}(p)$ corresponding to the continuing responses of the transfer function filters.

Since the convolutional calcualtions of the reference signal x, the adaptive digital filter $W_m$ and the transfer function filter $\hat{C}_{lm}$ can be made only by summing operations, the required drive signal calculations can be simplified and made at a higher rate. The number of the convolutional calculations required in the conventional noise reduction apparatus of the type using a signal indicating the noise production condition as the reference signal is as follows: Assuming now that the sampling frequency of the reference signal x is 1 kHz (or its sampling period is 1 msec), the filter length (tap number J) is 20, the channel number (L×M) is 8 (L=4, M=2) and the filter length (tap number I) of the adaptive digital filter $W_m$ is 6, the number of the required convolutional calculations of the reference signal x and the transfer function filter $\hat{C}_{lm}$ is $$J \times L \times M = 20 \times 4 \times 2 = 160$$

and the number of the required convolution calculations of the reference signal x and the adaptive digital filter $W_m$ is $$I \times M = 6 \times 2 = 12$$

Thus, the total number of the required convolutional calculations is $$160+12=172$$

Assuming now that the engine 4 is a four cylinder straight type engine and the engine speed is 1500 rpm, the noise period is 20 msec. Thus, the number of the convolutional calculations of the reference signal x and the transfer function filter $\hat{C}_{lm}$ required in the noise reducing apparatus of the invention is $$J \times L \times M/20=8$$

Although the engine speed is 1500 rpm, it is required to produce the control sounds over the entire range of one period by setting the tap number of the adaptive digital filter $W_m$ at 20 which is equal to the noise period (20 msec) divided by the sampling interval (1 msec, that is, the intervals at which the interrupt routine of FIG. 4 is entered). If the tap number of the adaptive digital filter $W_m$ is set at 20, it is possible to perform the convolutional calculations of the adaptive digital filter $W_m$ and the reference signal x merely by reading the filter coefficient $W_{mi}$ of the adaptive digital filter $W_m$ with no summing operation. Thus, the total number of the required calculations is two which is equal to the number M of the loudspeaker. That is, the total number of the convolutional calculations required for an engine speed of 1500 rpm in this embodiment is $$8+2=10$$

If the engine speed is 4500 rpm, the noise period will be about 6.7 msec. Thus, the number of the convolutional calculations of the transfer function filter $\hat{C}_{lm}$ and the reference signal x required in the noise reducing apparatus of the invention is $$J \times L \times M/6.7 \approx 24$$

20 The noise period is about 6.7 msec in the convolutional calcualtions of the adaptive digital filter $W_m$ and the reference signal x. Thus, summing operations will be required for two past impulse responses if the tap number of the adaptive digital filter $W_m$ is 20. Since one calculation is required for reading it and the number M of the loudspeakers is 2, the number of the required calculations is $$(2+1) \times 2=6$$

Thus, the total number of the calculations required in the noise reducing apparatus of the invention for an engine speed of 4500 rpm is $$24+6=30$$

If the engine speed is 7500 rpm, the noise period will be 4 msec. Thus, the number of the convolutional calculations of the transfer function filter $C_{lm}$ and the reference signal x required in the noise reducing apparatus of the invention is $$J \times L \times M/4 = 40$$

The noise period is 4 msec in the convolutional calculations of the adaptive digital filter $W_m$ and the reference signal x. Thus, summing operations will be required for four past impulse responses if the tap number of the adaptive digital filter $W_m$ is 20. Since one calculation is required for reading it and the number M of the loudspeakers is 2, the number of the required calculations is $$(4+1) \times 2 = 10$$

Thus, the total number of the calculations required in the noise reducing apparatus of the invention for an engine speed of 7500 rpm is $$40+10=50$$

Figure 7:
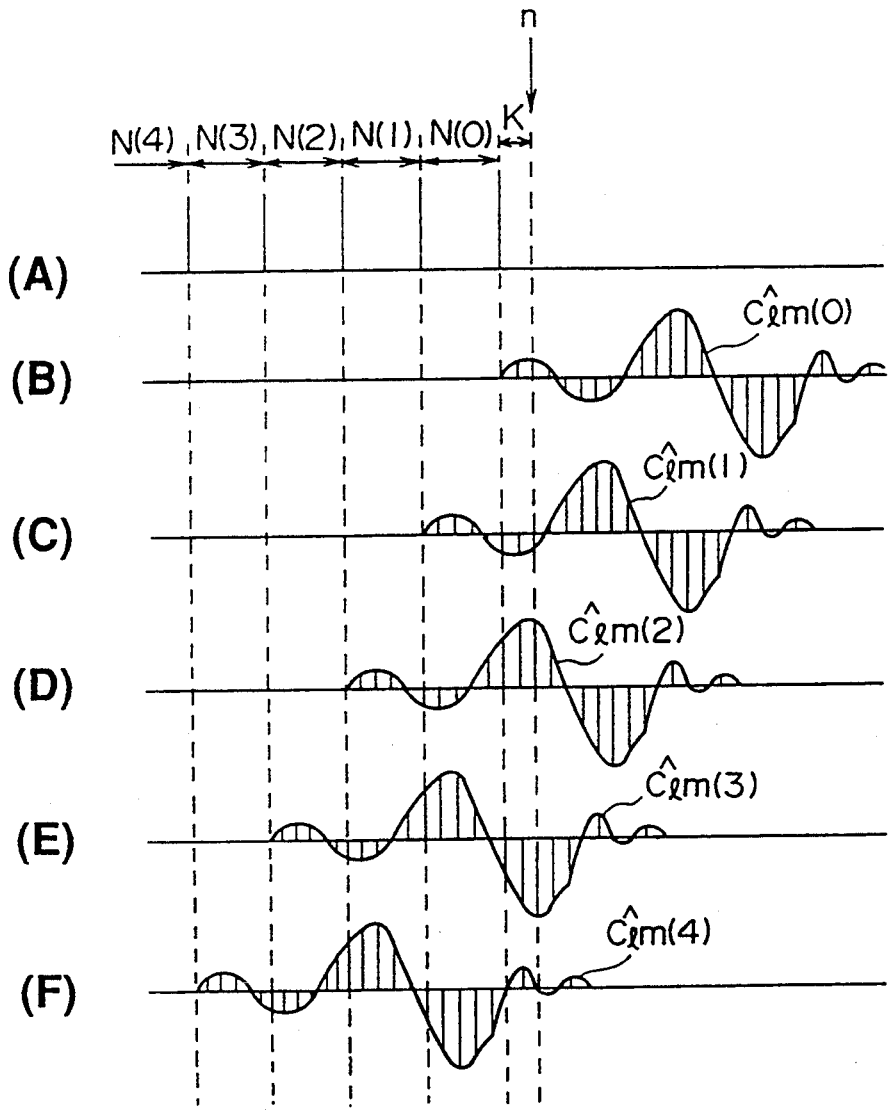
FIG. 7 contains six waveforms (A)–(F) used in explaining the problem associated with shortened noise FIG. 8 contains two waveforms (A) and (c) and their frequency characteristics (B) and (D)
Figure 8A:
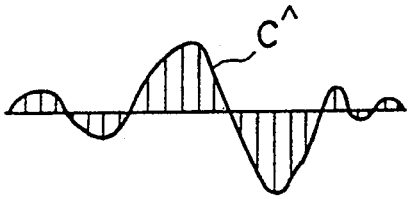
Figure 8B:
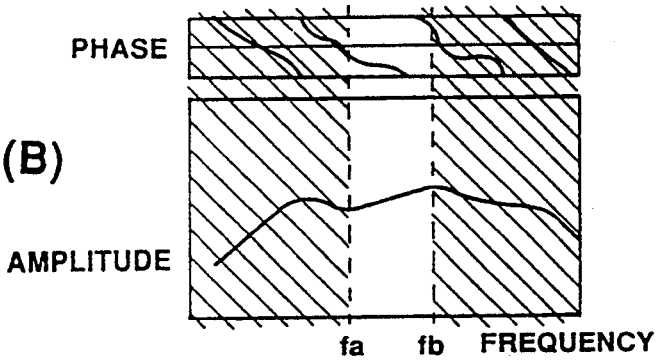
Figure 8C:
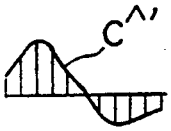
Figure 8D:
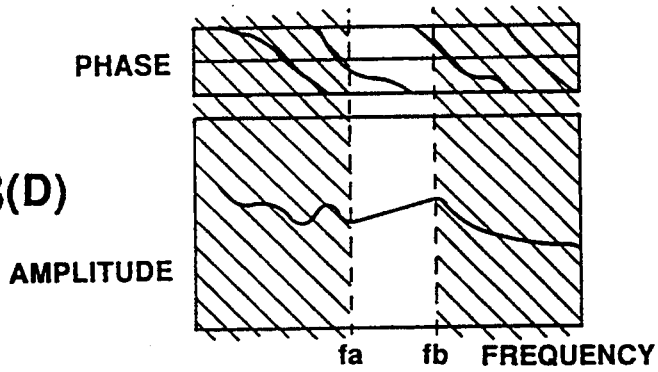

The number of calculations required for the convolutional calculations of the reference signal x and the transfer function filter $\hat{C}_{lm}$ increases as the noise period N decreases. The reason for this is that the information on the transfer function filter $\hat{C}_{lm}$ required for the convolutional calculations should be considered in times farther distance, as shown in FIGS. 7B to 7F, when the noise period N decreases, as shown in FIG. 7A. According to this embodiment, the noise period N is detected in the steps at the points 112 to 116 of FIG. 3. The transfer function filter $\hat{C}_{lm}(0)$ is set according to the detected noise period N in the step at the point 118 of FIG. 3. This is effective to prevent the required calculation number from increasing to an excessive extent even when the period N decreases. It is now assumed that the transfer function filter $\hat{C}$, which accurately indicates the acoustic transfer characteristics between the loudspeakers and the microphones, is as shown in FIG. 8A. Normally, the transfer function filter $\hat{C}$ should be used always. However, it is possible to reduce the noises to the same extent by using transfer function filter $\hat{C}'$ in place of the transfer function filter $\hat{C}$ if the frequency characteristics in the frequency band ranging from fa to fb of the frequency characteristics (see FIG. 8B) of the transfer function filter $\hat{C}$ agree with the frequency characteristics in the frequency band ranging from fa to fb of the frequency characteristics (see FIG. 8D) of the transfer function filter $\hat{C}'$ having a smaller number of taps, as shown in FIG. 8C, and if the frequency of the noises exists in the frequency band ranging from fa to fb. For this reason, the transfer function filter $\hat{C}'$ which is not so long with respect to the period N, as shown in FIG. 8C, is set in the step at the point 118 of FIG. 3. This is effective to provide a good noise reduction control without considering the information on the transfer function filter $\hat{C}_{lm}$ required for the convolutional calculations in times farther distance, as shown in FIGS. 7B to 7F. It is, therefore, possible to prevent the number of required calculations from increasing to an extreme extent as the period N decreases.

In this embodiment, the crankshaft position sensor 5 and the reference signal generating section 11 constitute the reference signal generating means. The reference processed signal generating section 14 and the steps at the points 222 to 230 of FIG. 4 constitute the reference processed signal generating means. The drive signal generating section 13 and the steps at the point 206 to 214 of FIG. 4 constitute the drive signal generating means. The adaptive processing section 17 and the step at the point 232 of FIG. 4 constitute the adaptive processing means. The period detecting means 12 constitutes the period detecting means. The transfer function filter storing section 15 and the steps at the points 112 to 118 constitute first filter length changing means.

Figure 9:
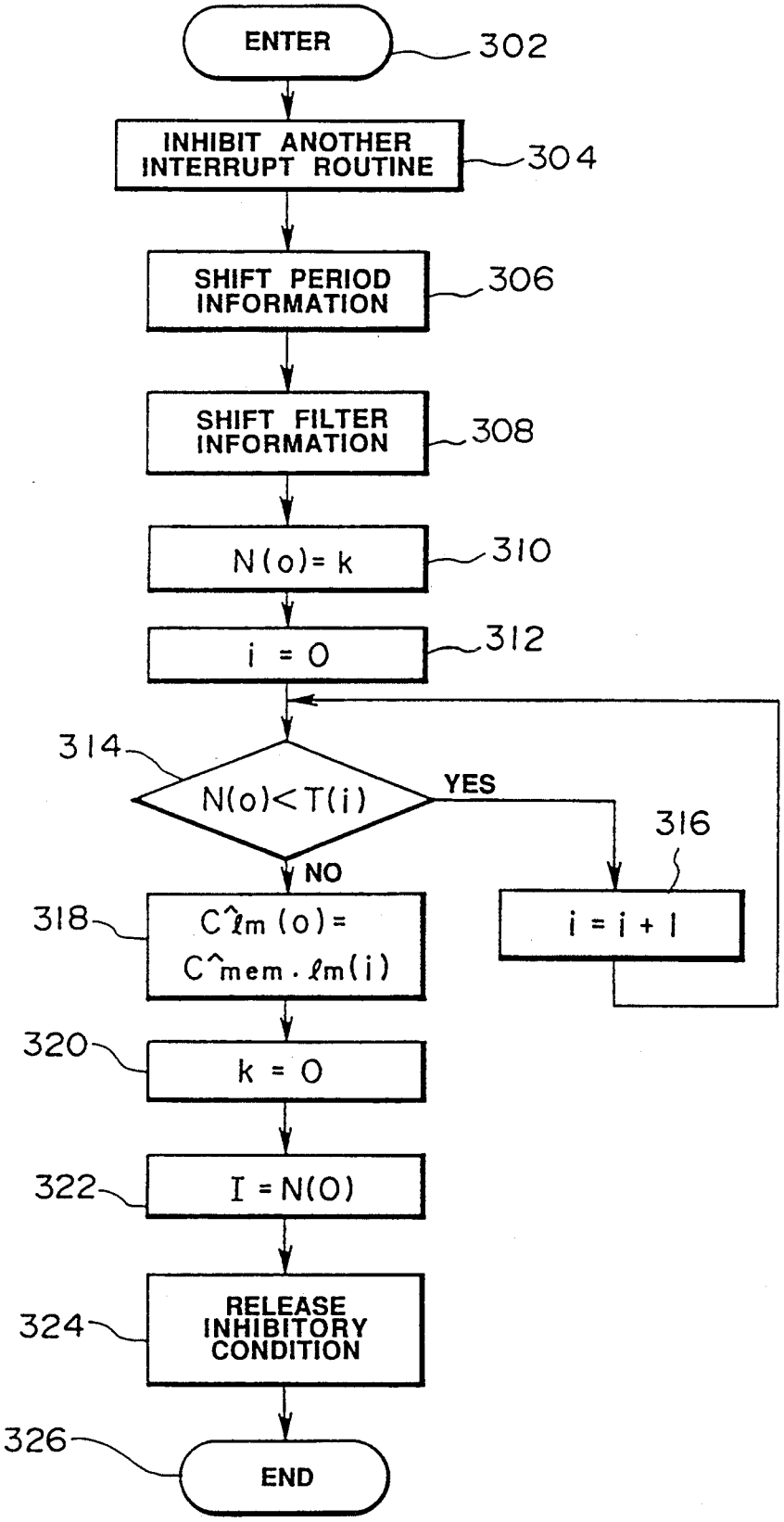
FIGS. 9 and 10 are flow diagrams of the programming of the digital computer as it is used in a modified form of the control unit of the invention.
Figure 10:
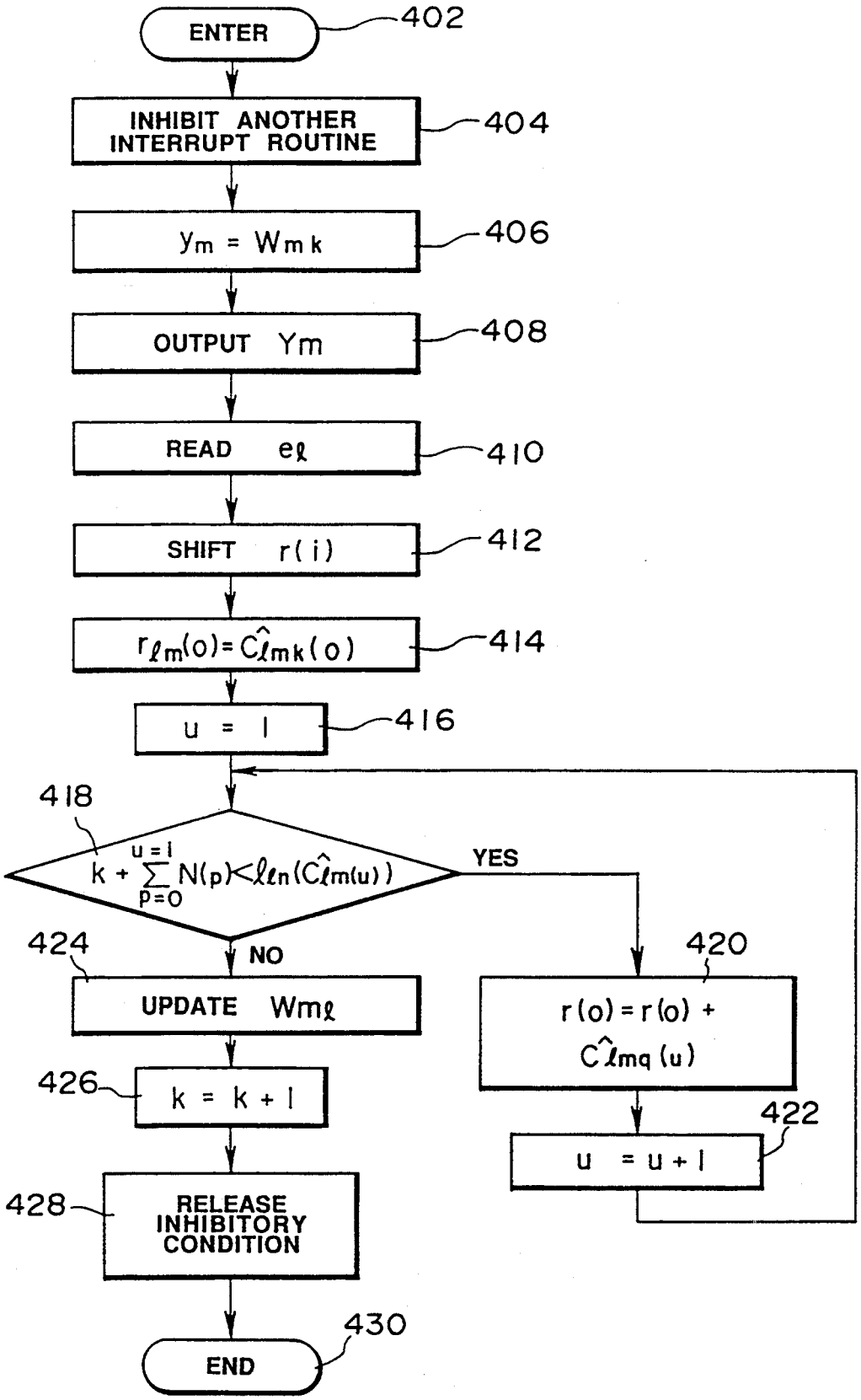

FIGS. 9 and 10 are flow diagrams showing a modified form of the programming of the digital computer used in the control unit 10. The computer program of FIG. 9 is entered at the point 302 in response to an interrupt signal in the form of an impulse of the reference signal x produced at uniform intervals of rotation of the engine crankshaft. At the point 304 in the program, another interrupt routine is inhibited. At the point 306, the central processing unit shifts the period information N(p) comprised of a series of past noise period values N(P)–N(1) (see FIGS. 5A and 6A) as follows:

$$N(P) = N(P-1)$$
$$N(P-1) = N(P-2)$$
$$\vdots$$
$$N(p) = N(p-1)$$
$$\vdots$$
$$N(2) = N(1)$$
$$N(1) = N(0)$$

The numeral enclosed by the parentheses () affixed to N indicates the number of times the period N was set before the new value is set therefor in the present cycle of execution of the program. At the point 308 in the program, the central processing unit shifts the filter information $\hat{C}_{lm}(p)$ comprised of a series of past transfer function values $\hat{C}_{lm}(P)$–$\hat{C}_{lm}(1)$ (see FIGS. 6B and 6C) as follows:

$$\hat{C}_{lm}(P) = \hat{C}_{lm}(P-1)$$
$$\hat{C}_{lm}(P-1) = \hat{C}_{lm}(P-2)$$
$$\vdots$$
$$\hat{C}_{lm}(p) = \hat{C}_{lm}(p-1)$$
$$\vdots$$
$$\hat{C}_{lm}(2) = \hat{C}_{lm}(1)$$
$$\hat{C}_{lm}(1) = \hat{C}_{lm}(0)$$

The numeral enclosed by the parentheses () affixed to $\hat{C}_{lm}$ indicates the number of times the transfer function filter $\hat{C}_{lm}$ was set before the new value is set therefor in the present cycle of execution of the program. At the point 310 in the program, the count k of the counter is stored in the computer memory as the newest value N(0) of the noise period N. At the point 312 in the program, the count i of an I counter is cleared to zero.

At the point 314 in the program, a determination is made as to whether or not N(0)<T(i). T(i) is one of stepped values into which the possible range of the period N is equally divided. If the answer to this question is "yes", then the program proceeds to the point 316 where the I counter is incremented by one step and it is returned to the point 314. Otherwise, it means that T(i) is the new period value N(0) stored in the computer memory to provide a part of the period information N(p) and the program proceeds to the point 318 where a new value $C_{lm}(0)$ of the filter information is set as $$C_{lm}^{\wedge}(0)=C_{mem.lm}^{\wedge}(i)$$

where $C_{mem.lm}^{\wedge}(i)$ is a predetermined transfer function filter calculated as a function of the period N. The predetermined transfer function filter has a filter length which is not too long with respect to the period N. According to the invention, the transfer function filter $C_{lm}^{\wedge}$ is set in such a manner that its filter length is not too long with respect to the period N. At the point 320 in the program, the count k of a K counter is cleared to zero. At the point 322 in the program, the filter length I of the adaptive digital filter $W_m$ is set at the noise period N(0). At the point 324 in the program, the inhibitory condition for another interrupt routine is released. Following this, the program proceeds to the end point 326.

The computer program of FIG. 10 is entered at the point 402 in response to an interrupt signal in the form of a drive signal $y_m$ produced from the control unit 10. At the point 404 in the program, another interrupt operation is inhibited. At the point 406 in the program, the value of the drive signal $y_m$ is initiated to $W_{mk}$ as:

$$y_m=W_{mk}$$

where $W_{mk}$ is the k-th filter coefficient of the adaptive digital filter $W_m$. Thus, the initial value of the drive signal $y_m$ set at the point 406 indicates the response of the adaptive digital filter $W_m$ at the present time k with respect to the last impulse. Since the count k of the K counter is cleared to zero at the point 320 in the program of FIG. 9, the value k is set at zero when a pulse x(n) of the reference signal x is produced. Thus, the value k indicates the number of times the program of FIG. 10 has been executed after the pulse x(n) of the reference signal was produced (see FIGS. 5A and 6A). At the point 408 in the program, the drive signal $y_m$ is outputted. At the point 410 in the program, the residual noise signals e1 to e8 are read into the computer memory. At the point 412 in the program, the registers $r_{lm}(I)$ to $r_{lm}(1)$ storing the reference processed signal $r_{lm}$ obtained in the past processes are shifted as:

$$\begin{aligned}
r_{lm}(I) &= r_{lm}(I-1)\\
r_{lm}(I-1) &= r_{lm}(I-2)\\
&\vdots\\
r_{lm}(i) &= r_{lm}(i-1)\\
&\vdots\\
r_{lm}(2) &= r_{lm}(1)\\
r_{lm}(1) &= r_{lm}(0)
\end{aligned}$$

At the point 414 in the program, the register $r_{lm}(0)$ is initialized as:

$$r_{lm}(0)=C_{lm}^{\wedge}(0)$$

where $C_{lmk}^{\wedge}(0)$ is the k-th filter coefficient of the newest transfer function filter $C_{lm}^{\wedge}(0)$ set at the point 118 in the program of FIG. 3 and it indicates the response of the transfer function filter $C_{lm}^{\wedge}(0)$ at the present time k to the last impulse. At the point 416 in the program, the U counter is set at 1.

At the point 418 in the program, a determination is made as to whether or not $$k+\sum_{p=0}^{u-1} N(p) < len(C_{lm}^{\wedge}(u))$$

where $len(C_{lm}^{\wedge}(u))$ is the filter length (tap number) of the transfer function filter $C_{lm}^{\wedge}(u)$ with respect to the impulse inputted u impulses before. If the answer to this question is "yes", then it means that the response of the transfer function filter $C_{lm}^{\wedge}(u)$ to the impulse inputted u impulses before still continues and the program proceeds to the point 420 where an integration is made for the register $r_{lm}(0)$ as:

$$r_{lm}(0)=r_{lm}(0)+C_{lmq}^{\wedge}(u)$$

where q is given as $$q=k+\sum_{p=0}^{u-1} N(p)$$

where $C_{lmq}^{\wedge}$ is the response of the transfer function filter $C_{lm}^{\wedge}(u)$ to the impulse inputted u impulses before. At the point 422 in the program, the U counter is incremented by one step. Following this, the program is returned to the point 418.

If the answer to the question inputted at the point 418 is "no", then it means that the response of the adaptive digital filter $W_m$ to the impulse inputted u pulses before the time was distinguished and, thus, the convolutional calculations in the drive signal generating section 14 have been completed and the program proceeds to the point 424. At the point 424 in the program, the LMS algorithm is used to update the filter coefficients $W_{mi}$ of the respective adaptive digital filters $W_m$ as:

$$\begin{aligned}
W_{m0} &= W_{m0} - \alpha \sum_{l=1}^{L} r_{lm}(0)el\\
W_{m1} &= W_{m1} - \alpha \sum_{l=1}^{L} r_{lm}(1)el\\
&\vdots\\
W_{mi} &= W_{mi} - \alpha \sum_{l=1}^{L} r_{lm}(i)el\\
&\vdots\\
W_{mI} &= W_{mI} - \alpha \sum_{l=1}^{L} r_{lm}(I)el
\end{aligned}$$

where $\alpha$ is the convergence coefficient that takes part in the rate at which the filter converges in an optimum fashion and contributes to the stability of the optimum convergence of the filter. At the point 426 in the program, the K counter is incremented by one step. At the point 428 in the program, the inhibitory condition for another interrupt routine is released. Following this, the program proceeds to the end point 430.

In this modification, the filter coefficient $W_{mk}$, that is, the response of the adaptive digital filter $W_m$ to the newest impulse is outputted as the drive signal $y_m$. This is effective to eliminate the need for summing operations in the convolutional calculations of the adaptive digital filter $W_m$ and the reference signal x. It is, therefore, possible to prevent the required calculation number from increasing as the period N decreases. Although this process is equivalent to a shortage of the filter length of the adaptive digital filter $W_m$, it will cause no control characteristic deterioration since the filter length of the adaptive digital filter $W_m$ is set a little longer in order to avoid the problem (that no drive signal is produced in the latter half of the period) caused by the fact that the reference signal x is in the form of a series of impulses. At a shortened filter length I, the number of calculations required, in the step at the point 424 of FIG. 10, in updating the filter coefficient $W_{mi}$ can be reduced. This is effective to provide a higher rate noise reduction control. The step at the point 322 of FIG. 9 and the steps at the points 406 and 408 of FIG. 10 constitute the second filter length changing means.

Figure 11:
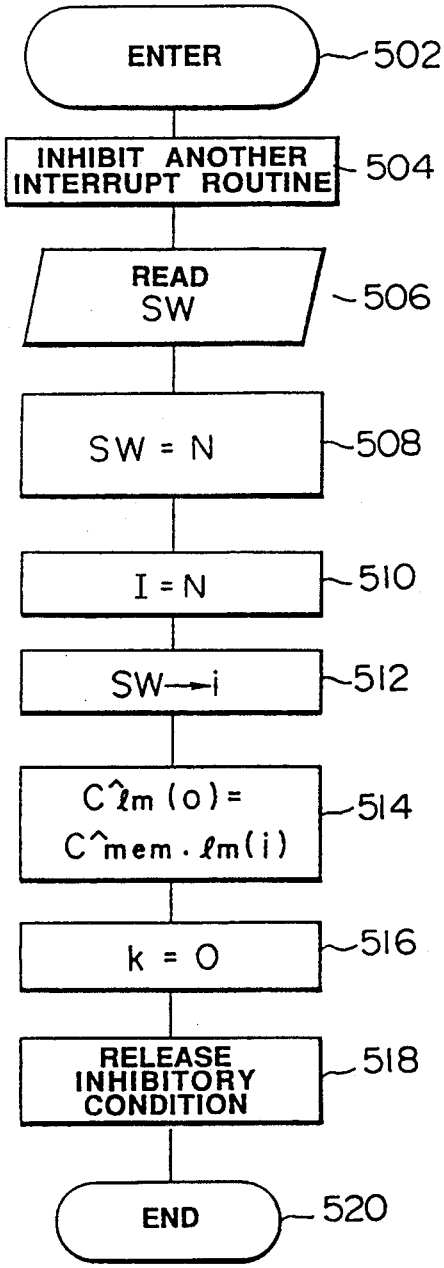
FIGS. 11 and 12 are flow diagrams of the programming of the digital computer as it is used in another modified form of the control unit of the invention.
Figure 12:
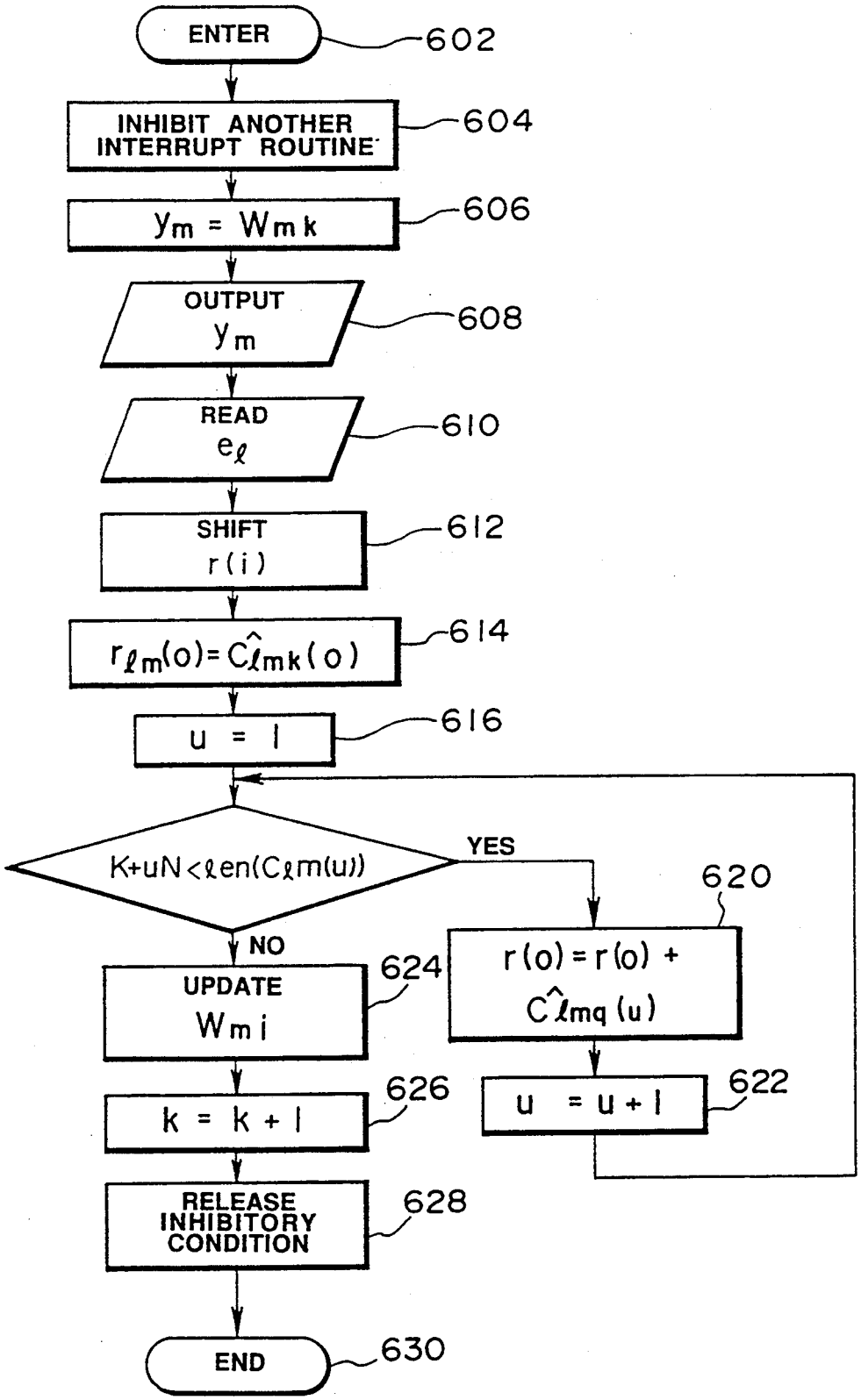

FIGS. 11 and 12 are flow diagrams showing another modified form of the programming of the digital computer used in the control unit 10. This modification is applicable to reduce the noises transmitted from the air conditioner fan in to the vehicle passenger compartment. Since the fan speed is determined by the position of the air conditioner switch, the period of the transmitted noises can be detected as a function of the position of the air conditioner switch.

The computer program of FIG. 11 is entered computer program is entered at the point 502. At the point 504 in the program, another interrupt routine is inhibited. At the point 506 in the program, the central processing unit reads the switch position signal SW indicative of the position of the air conditioner. At the point 508 in the program, the noise period N is detected based upon the read value of the switch position signal SW. It is possible to simplify the noise reduction processes by considering that the noise period is constant. At the point 510 in the program, the filter length I of the adaptive digital filter $W_m$ is set at the value equal to the detected period N. At the point 512 in the program, the order i of the grade of the noise period N is set according to the switch position signal SW.

At the point 514 in the program, a new value $C_{lm}(0)$ of the filter information is set as $$\hat{C}_{lm}(0)=\hat{C}_{mem.lm}(i)$$

where $\hat{C}_{mem.lm}(i)$ is a predetermined transfer function filter calculated as a function of the period N. The predetermined transfer function filter has a filter length which is not too long with respect to the period N. According to the invention, the transfer function filter $\hat{C}_{lm}$ is set in such a manner that its filter length is not too long with respect to the period N. At the point 516 in the program, the count k of the K counter is cleared to zero. At the point 518 in the program, the inhibitory condition for another interrupt routine is released. Following this, the program proceeds to the end point 520.

The computer program of FIG. 12 is entered at the point 602 in response to an interrupt signal in the form of a drive signal $y_m$ produced from the control unit 10. At the point 604 in the program, another interrupt operation is inhibited. At the point 606 in the program, the value of the drive signal $y_m$ is initiated to the k-th filter coefficient Wink of the adaptive digital filter $W_m$ as:

$$y_m=W_{mk}$$

At the point 608 in the program, the drive signal $y_m$ is outputted. At the point 610 in the program, the residual noise signals e1 to e8 are read into the computer memory. At the point 612 in the program, the registers $r_{lm}(I)$ to $r_{lm}(1)$ storing the reference processed signal $r_{lm}$ obtained in the past processes are shifted as:

$$r_{lm}(I) = r_{lm}(I-1)$$
$$r_{lm}(I-1) = r_{lm}(I-2)$$
$$\vdots$$
$$r_{lm}(i) = r_{lm}(i-1)$$
$$\vdots$$
$$r_{lm}(2) = r_{lm}(1)$$
$$r_{lm}(1) = r_{lm}(0)$$

At the point 614 in the program, the register $r_{lm}(0)$ is initialized as:

$$r_{lm}(0)=\hat{C}_{lmk}(0)$$

where $\hat{C}_{lmk}(0)$ is the k-th filter coefficient of the newest transfer function filter $\hat{C}_{lm}(0)$ set at the point 514 in the program of FIG. 11 and it indicates the response of the transfer function filter $\hat{C}_{lm}(0)$ at the present time k to the last impulse. At the point 616 in the program, the U counter is incremented by one step.

At the point 618 in the program, a determination is made as to whether or not $$k+uN<len(\hat{C}_{lm}(u))$$

where $len(\hat{C}_{lm}(u))$ is the filter length (tap number) of the transfer function filter $\hat{C}_{lm}(u)$ with respect to the impulse inputted u impulses before. If the answer to this question is "yes", then it means that the response of the transfer function filter $\hat{C}_{lm}(u)$ to the impulse inputted u impulses before still continues and the program proceeds to the point 620 where an integration is made for the register $r_{lm}(0)$ as:

$$r_{lm}(0)=r_{lm}(0)+\hat{C}_{lmq}(u)$$

where q is given as $$q = k + \sum_{p=0}^{u-1} N(p)$$

where $\hat{C}_{lmq}$ is the response of the transfer function filter $\hat{C}_{lm}(u)$ to the impulse inputted u impulses before. At the point 622 in the program, the U counter is incremented by one step. Following this, the program is returned to the point 618.

If the answer to the question inputted at the point 618 is "no", then it means that the response of the adaptive digital filter $W_m$ to the impulse inputted u pulses before the time was distinguished and, thus, the convolutional calculations in the drive signal generating section 14 have been completed and the program proceeds to the point 624. At the point 624 in the program, the LMS algorithm is used to update the filter coefficients $W_{mi}$ of the respective adaptive digital filters $W_m$ as:

$$W_{m0} = W_{m0} - \alpha \sum_{l=1}^{L} r_{lm}(0)el$$
$$W_{m1} = W_{m1} - \alpha \sum_{l=1}^{L} r_{lm}(1)el$$
$$\vdots$$
$$W_{mi} = W_{mi} - \alpha \sum_{l=1}^{L} r_{lm}(i)el$$

-continued $$W_{mI} = W_{mI} - \alpha \sum_{l=1}^{L} r_{lm}(I)el$$

where $\alpha$ is the convergence coefficient that takes part in the rate at which the filter converges in an optimum fashion and contributes to the stability of the optimum convergence of the filter. At the point 626 in the program, the K counter is incremented by one step. At the point 628 in the program, the inhibitory condition for another interrupt routine is released. Following this, the program proceeds to the end point 630.

In this modification, the steps at the points 506 and 508 of FIG. 11 constitute the noise period detecting means.

Although the invention has been described in connection with noise reducing apparatus for reducing the noises transmitted into a vehicle passenger compartment from the engine or air conditioner installed on the vehicle, it is to be noted, of course, that the invention is also applicable to other periodical noises if a reference signal comprised of a series of impulses having the same period of the noises can be formed. For example, the active noise reduction apparatus may be arranged to reduce the noises transmitted from the transmission gear box into the vehicle passenger compartment. In this case, the reference signal may be formed based upon the transmission shaft rotation signal and the transmission gear position signal. The noise reducing apparatus may be arranged to reduce the noises produced in the final reduction gear. In this case, the reference signal may be formed based upon the final reduction gear rotation signal. The noise reducing apparatus may be arranged to reduce the noises transmitted from the drive shaft. In this case, the reference signal may be formed based upon the drive shaft rotation signal. The noise reducing apparatus may be arranged to reduce the noises transmitted from the propeller shaft. In this case, the reference signal may be formed based upon the propeller shaft rotation signal. The noise reducing apparatus may be arranged to reduce the noises transmitted from the air conditioner compressor. In this case, the reference signal may be formed based upon the compressor rotation signal. The noise reducing apparatus may be arranged to reduce the noises transmitted from the radiator fan. In this case, the reference signal may be formed based upon the radiator fan rotation signal. The noise reducing apparatus may be arranged to reduce the noises transmitted from the supercharger. In this case, the reference signal may be formed based upon the supercharger rotation signal. The noise reducing apparatus may be arranged to reduce the noises transmitted from the water pump or oil pump. In this case, the reference signal may be formed based upon the pump rotation signal. The noise reducing apparatus may be arranged to reduce the noises transmitted from the alternator. In this case, the reference signal may be formed based upon the alternator rotation signal. The noise reducing apparatus may be arranged to reduce the noises transmitted from road wheels. In this case, the reference signal may be formed based upon the road wheel rotation signal.

Although the invention has been described in connection with the crankshaft position signal used as the noise related signal, it is to be noted, of course, that the noise related signal may be in the form of a signal produced in synchronism with combustion in the engine 4.

What is claimed is:

1. An apparatus for reducing periodical noises transmitted from a noise source into a vehicle passenger compartment, comprising:

control sound sources for producing control sounds in the vehicle passenger compartment;

reference signal generating means for producing a reference signal in the form of a series of impulses having the same period as the noises;

residual noise detecting means for detecting residual noises at predetermined positions in the vehicle passenger compartment;

transfer function filters modeled on transfer functions between the control sound sources and the residual noise detecting means;

reference processed signal generating means for convoluting the transfer function filters with the reference signal to produce reference processed signals;

adaptive digital filters having variable filter coefficients;

drive signal generating means for convoluting the adaptive digital filters with the reference signal to generate drive signals to drive the control sound sources; and adaptive processing means for updating the filter coefficients of the respective adaptive digital filters based on the reference processed signals and the residual noises to reduce the noises in the vehicle passenger compartment.

2. The apparatus as claimed in claim 1, further comprising noise period detecting means for detecting the period of the noises produced from the noise source, and first filter length changing means for changing the filter lengths of the respective transfer function filters based upon the detected noise period.

3. The apparatus as claimed in claim 2, further comprising second filter length changing means for changing the filter lengths of the respective adaptive digital filters based upon the detected noise period.

4. An apparatus for actively reducing noises transmitted into a vehicle passenger compartment, comprising:

(a) control sound source means for operatively generating and transmitting control sounds toward the vehicle compartment into which the noises from at least one noise source are transmitted, the noises being periodical noises;

(b) reference signal generating means for generating an impulse string having the same period as the noises generated from said noise source;

(c) residual noise detecting means for detecting residual noise sounds at a predetermined area of the vehicle compartment;

(d) a transfer function filter which is so constructed as to indicate a model of a spatial acoustic transfer function between the control sound source means and residual noise detecting means;

(e) reference processed signal generating means for convoluting the transfer function filter with the reference signal of said reference signal generating means so as to provide a reference processed signal;

(f) an adaptive digital filter having variable filter coefficients;

(g) drive signal generating means for convoluting the adaptive digital filter with the reference signal of said reference signal generating means so as to generate drive signals, the drive signals being supplied to the control sound source means to drive them; and (h) adaptive processing means for updating filter coefficients of said adaptive digital filter on the basis of the reference processed signal and residual noise sound indicative signal from said residual noise detecting means so as to reduce the noises within the vehicle compartment.

5. An apparatus for actively reducing noises transmitted into a vehicle passenger compartment as set forth in claim 4, which further comprises:

(i) noise period detecting means for detecting a period of said noises generated from said noise source; and (j) first tap number changing means for changing a tap number of said transfer function filter on the basis of the detected period of said noise period detecting means.

6. An apparatus for actively reducing noises transmitted into a vehicle passenger compartment as set forth in claim 5, which further comprises (k) second tap number changing means for changing a tap number of said adaptive digital filter on the basis of the detected period of said noise period detecting means.

7. An apparatus for actively reducing noises transmitted into a vehicle passenger compartment as set forth in claim 6, wherein said reference signal generating means includes a crankshaft angular position sensor which is so constructed as to produce a crank angle signal X whose period is the same as the vibration period of a vehicular engine and said reference signal generating means generate the reference signal X constituted by the impulse string having the same period of the vibration period of said engine and said noise period detecting means comprises the period determining means for determining the period N of the vibration generated on the engine on the basis of the crank angle signal.

8. An apparatus for actively reducing noises transmitted into a vehicle passenger compartment as set forth in claim 7, wherein said control sound source means comprises a plurality of loud speakers (*7a* through *7d*), the adaptive digital filter has the number of filter coefficients $W_m$ (m=1 to M) which corresponds to the number of loud speakers, the transfer function filter being modeled in the form of an finite impulse response function of $\hat{C}lm$ (1=1 to L, L means the number of microphones constituting the residual noise detecting means), said drive signal generating means convolutes the reference signal X with the adaptive digital filter $W_m$ (m=1 to M) and outputs the drive signals $y_1$ to $y_4$ to the respective loud speakers, and said reference processed signal generating means generates and outputs the reference processed signal $r_{lm}$ by convoluting the transfer function filter $\hat{C}_{lm}$ with the reference signal X.

9. An apparatus for actively reducing noises transmitted into a vehicle passenger compartment as set forth in claim 8, which further comprises:

(k) transfer function filter storing means for setting the transfer function filter $\hat{C}_{lm}$ within said reference processed signal generating means on the basis of said period N derived from the period determining means; and (l) a register which is so constructed as to temporarily store said reference processed signal $r_{lm}$.

10. An apparatus for actively reducing noises transmitted into a vehicle passenger compartment as set forth in claim 9, wherein said adaptive processing means updates each filter coefficient $W_{mi}$ of the adaptive digital filter on the basis of the registered reference processed signal $r_{lm}$ and residual noise signals $e_1$ to $e_8$ so as to reduce the noises within the vehicle compartment.

11. An apparatus for actively reducing noises transmitted into a vehicle passenger compartment as set forth in claim 10, wherein said adaptive processing means updates the registered reference processed signal using a Least Mean Square algorithm.

12. An apparatus for actively reducing noises transmitted into a vehicle passenger compartment as set forth in claim 11, wherein whenever the reference signal X is generated, a period information N(P) through N(1) of the period N of the noises is shifted as follows:

$$N(P) = N(P-1)$$
$$N(P-1) = N(P-2)$$
$$\vdots$$
$$N(P) = N(P-1)$$
$$\vdots$$
$$N(2) = N(1)$$
$$N(1) = N(0),$$

a transfer function filter information storing previous values of the transfer function filter $\hat{C}_{lm}(P)$ ~ $\hat{C}_{lm}(1)$ is shifted as follows:

$$\hat{C}_{lm}(P) = \hat{C}_{lm}(P-1)$$
$$\hat{C}_{lm}(P-1) = \hat{C}_{lm}(P-2)$$
$$\vdots$$
$$\hat{C}_{lm}(P) = \hat{C}_{lm}(P-1)$$
$$\hat{C}_{lm}(2) = \hat{C}_{lm}(1)$$
$$\hat{C}_{lm}(1) = \hat{C}_{lm}(0)$$

wherein numerals within each bracket () denote how many times before the previous processing has been carried out for the set period N and transfer function filter $\hat{C}_{lm}$ with respect to the present processing, the latest noise period N is stored as the period information N(0), and the latest noise period N (0) is compared with T(i), wherein T(i) denotes a value at each predetermined stage, a range of time at which the period N can be obtained being divided into each predetermined stage so that a length of the period N stored in the latest period information N (0) can be determined, and if N (0) T(i), the transfer function filter information $\hat{C}_{lm}$ is set as follows:

$$\hat{C}_{lm}(0) = \hat{C}_{mem.lm}(i), \text{ wherein } \hat{C}_{mem.lm}(i)$$

denotes a transfer function filter previously stored so as to correspond to the length of the period N.

13. An apparatus for actively reducing noises transmitted into a vehicle passenger compartment as set forth in claim 12, wherein an initialization of the drive signals $y_m$ is set as follows:

$Y_m = W_{mk}$, wherein $W_{mk}$ denotes a k-th number filter coefficient to the adaptive digital filter $W_m$, and wherein a maximum tap number I of the adaptive digital filter is determined as follows:

$$k + \sum_{p=0}^{u-1} N(p) < I$$

wherein k denotes a number of times an interrupt processing is carried out until the reference signal v(n) is generated, and an accumulation of $y_m$ is carried out as follows:

$$y_m = y_m + W_{mq}, \text{ wherein } q = k + \sum_{p=0}^{u-1} N(P), \text{ and}$$

$W_{mq}$ denotes a response to the adaptive digital filter $W_m$ to the input of the impulse string before the u-th number.

14. An apparatus for actively reducing noises transmitted into a vehicle passenger compartment as set forth in claim 13, wherein each filter coefficient $W_{mi}$ of the adaptive digital filter is expressed as:

$$W_{m0} = W_{m0} - \alpha \sum_{1-1}^{L} r_{lm}(0)e_1$$

$$W_{m1} = W_{m1} - \alpha \sum_{1=1}^{L} r_{lm}(1)e_1$$

$$\vdots$$

$$W_{mi} = W_{mi} - \alpha \sum_{1=1}^{L} r_{lm}(i)e_1$$

$$\vdots$$

$$W_{m1} = W_{m1} - \alpha \sum_{1=1}^{L} r_{lm}(I)e_1$$

wherein $\alpha$ denotes a convergence coefficient.

* * * * *